US006901625B2

(12) United States Patent
Yang et al.

(10) Patent No.: US 6,901,625 B2
(45) Date of Patent: Jun. 7, 2005

(54) DUST COLLECTION UNIT FOR USE IN VACUUM CLEANER AND MAIN BODY OF VACUUM CLEANER HAVING THE SAME

(75) Inventors: Byung-Sun Yang, Changwon Gyeongnam (KR); Myung-Sig Yoo, Changwon Gyeongnam (KR)

(73) Assignee: LG Electronics Inc., Seoul (KR)

( * ) Notice: Subject to any disclaimer, the term of this patent is extended or adjusted under 35 U.S.C. 154(b) by 395 days.

(21) Appl. No.: 10/151,158

(22) Filed: May 21, 2002

(65) Prior Publication Data

US 2003/0066156 A1 Apr. 10, 2003

(30) Foreign Application Priority Data

Oct. 9, 2001 (KR) ..... 2001-62163

(51) Int. Cl.[7] ..... A47L 9/16
(52) U.S. Cl. ..... 15/347; 15/327.1; 15/327.7
(58) Field of Search ..... 15/327.1, 327.2, 15/327.6, 327.7, 347, 350, 351, 352, 353; 55/337, 429, 459.1, 482, 486

(56) References Cited

U.S. PATENT DOCUMENTS 4,172,710 A * 10/1979 van der Molen ..... 55/340
6,228,260 B1 * 5/2001 Conrad et al. ..... 210/304
6,406,505 B1 * 6/2002 Oh et al. ..... 55/337
6,578,230 B2 * 6/2003 Park et al. ..... 15/353
6,599,350 B1 * 7/2003 Rockwell et al. ..... 96/135
6,647,587 B1 * 11/2003 Ohara et al. ..... 15/350
2002/0032947 A1 * 3/2002 Oh et al. ..... 15/323

* cited by examiner

*Primary Examiner*—Terrence R. Till
(74) *Attorney, Agent, or Firm*—Fleshner & Kim LLP

(57) ABSTRACT

The present invention relates to a dust collection unit for use in a vacuum cleaner. According to the present invention, there is provided a dust collection unit for use in a vacuum cleaner which comprises a cylindrical casing in which air introduced through an inlet port is formed into spiral flow and of which an upper end is open; a cover for opening and closing the upper end of the casing; a filter which is installed on a bottom surface of the cover and formed in the shape of a cylinder having a predetermined length and by which fine foreign substances can be filtered out when the air is introduced from the exterior thereof, and through which the air is discharged downwardly; and an exhaust duct which comes into close contact with a bottom surface of the filter and including an exhaust port on a side surface of the casing to discharge the air from the filter to the exterior of the casing. It is preferred that the exhaust port of the casing be formed at a lower portion of the side surface of the casing.

23 Claims, 7 Drawing Sheets

DUST COLLECTION UNIT FOR USE IN VACUUM CLEANER AND MAIN BODY OF VACUUM CLEANER HAVING THE SAME

BACKGROUND OF THE INVENTION

1. Field of the Invention

The present invention relates to a dust collection unit for use in a vacuum cleaner, and more particularly, to a dust collection unit for use in a vacuum cleaner which is constructed such that air flow path within a main body of the vacuum cleaner can be simplified while using a cyclone method of collecting dusts.

2. Description of the Prior Art

A vacuum cleaner is constructed such that air containing foreign substances is sucked into a main body of the vacuum cleaner using a suction force generated from the main body in which the foreign substances are in turn filtered out, and the air filtered clean is then discharged to the exterior of the main body.

To this end, a motor for generating the suction force and the like are installed within the main body of the vacuum cleaner. A filter means for filtering out the air to be sucked therein is also installed within the main body of the vacuum cleaner. A dust collection bag formed of paper is generally used as a conventional filter means. The dust collection bag allows only the air to pass therethrough but the foreign substances such as dusts to be collected therein.

However, after the foreign substances such as dusts and the like have been collected in the dust collection bag, the dust collection bag with the foreign substances contained therein is generally discarded. Thus, waste of material is brought about. In particular, there is a critical disadvantage in that the dust collection efficiency of the vacuum cleaner is further lowered as the dusts are collected in the dust collection bag.

In order to solve the above problems, a cyclone type dust collection unit has been developed. The cyclone type dust collection unit allows spiral flow to be created within a casing thereof when the air containing foreign substances is introduced into the casing.

As shown in FIG. 1, at one side of a main body 1 of a vacuum cleaner is installed a dust collection unit 2 which is constructed such that a primary dust collection using the cyclone method and a secondary dust collection using a filter can be performed. Accordingly, when the vacuum cleaner is operated, air containing foreign substances, which is sucked up through a suction nozzle 4, is introduced through an extension tube 6 and a connecting hose 8 into the main body 1 of the vacuum cleaner.

As shown in FIGS. 2 and 3, the air introduced through an inlet port 21 into the dust collection unit 2 is formed into spiral flow within a casing 22. Relatively heavy foreign substances fall downwardly due to their own weight. The air from which the heavy foreign substances have been removed is introduced into a filter 23, and is then exhausted through an outlet 24 formed on an upper end of the filter. The filter 23 is installed on a bottom surface of a cover 25 for substantially opening and closing the casing 22. Such collection unit is advantageous in that the relatively heavy foreign substances can be removed through the primary dust collection using the cyclone method and even fine dusts can also be completely filtered out through the secondary dust collection using the filter 23.

Air flow after the outlet will be described in detail with reference to FIG. 3. As shown in the figure, the outlet 24 is provided on a top surface of the dust collection unit 2. Accordingly, the air discharged through the outlet 24 is guided along a connection duct 26 which is constructed to connect the outlet 24 and a motor housing H contained within the main body of the vacuum cleaner above the dust collection unit 2. Accordingly, the connection duct 26 for connecting the outlet positioned on the top surface of the dust collection unit 2 and the motor housing H positioned lower than the dust collection unit within the main body of the vacuum cleaner is formed in a vertically downward direction.

However, such a conventional structure has the following disadvantages: Since the connection duct 26 should be used for connecting the dust collection unit 2 and the motor housing H, any suction loss may be generated at their respective connecting portions. Since this suction loss results in substantial reduction of the suction efficiency of the vacuum cleaner, it has an adverse influence on the performance of the vacuum cleaner. Furthermore, since the connection duct 26 is additionally installed, the number of parts is increased and the assembly process becomes complex. Thus, there are problems in that the production costs are increased and the productivity is lowered.

SUMMARY OF THE INVENTION

The present invention is contemplated to solve the aforementioned problems in the prior art. An object of the present invention is to provide a dust collection unit constructed such that double filtering process using a cyclone method and a filter can be performed and simultaneously the inner structure of a main body of a vacuum cleaner can be more simplified, and a main body of a vacuum cleaner having the dust collection unit.

In order to accomplish the object, according to the present invention, there is provided a dust collection unit for use in a vacuum cleaner, comprising: a cylindrical casing in which air introduced through an inlet port is formed into spiral flow and of which an upper end is open; a cover for opening and closing the upper end of the casing; a filter which is installed on a bottom surface of the cover and formed in the shape of a cylinder having a predetermined length and by which fine foreign substances can be filtered out when the air is introduced from the exterior thereof, and through which the air is discharged downwardly; and an exhaust duct which comes into close contact with a bottom surface of the filter and including an exhaust port on a side surface of the casing to discharge the air from the filter to the exterior of the casing.

It is preferred that the exhaust port is formed at a lower portion of the side surface of the casing.

According to another embodiment of the present invention, a horizontal separation plate is installed in the middle of the casing, and a dust collection hole is formed on the outer circumference of the separation plate.

According to a further embodiment of the present invention, the separation plate includes a pair of semicircular plates, and the respective semicircular plates are pivoted only upwardly on a hinge end formed on an outer circumferential position thereof corresponding to an outmost position of the diameter thereof.

It is a technical spirit that a main body of a vacuum cleaner according to the present invention, comprising: a motor housing installed within the main body of the vacuum cleaner for accommodating therein a motor for generating suction force; and a dust collection unit installed adjacent to the motor housing, and including an exhaust port through which, after filtering out foreign substances from air introduced by the suction force of the motor, the filtered air is exhausted, wherein the exhaust port of the dust collection unit is formed on a side surface of the dust collection unit so that the air can be introduced directly to the motor housing.

BRIEF DESCRIPTION OF THE DRAWINGS

The above and other objects and features of the present invention will become apparent from the following description of a preferred embodiment given in conjunction with the accompanying drawings, in which.

DETAILED DESCRIPTION OF THE PREFERRED EMBODIMENTS

Hereinafter, preferred embodiments of the present invention will be described in detail with reference to the accompanying drawings.

Figure 1:
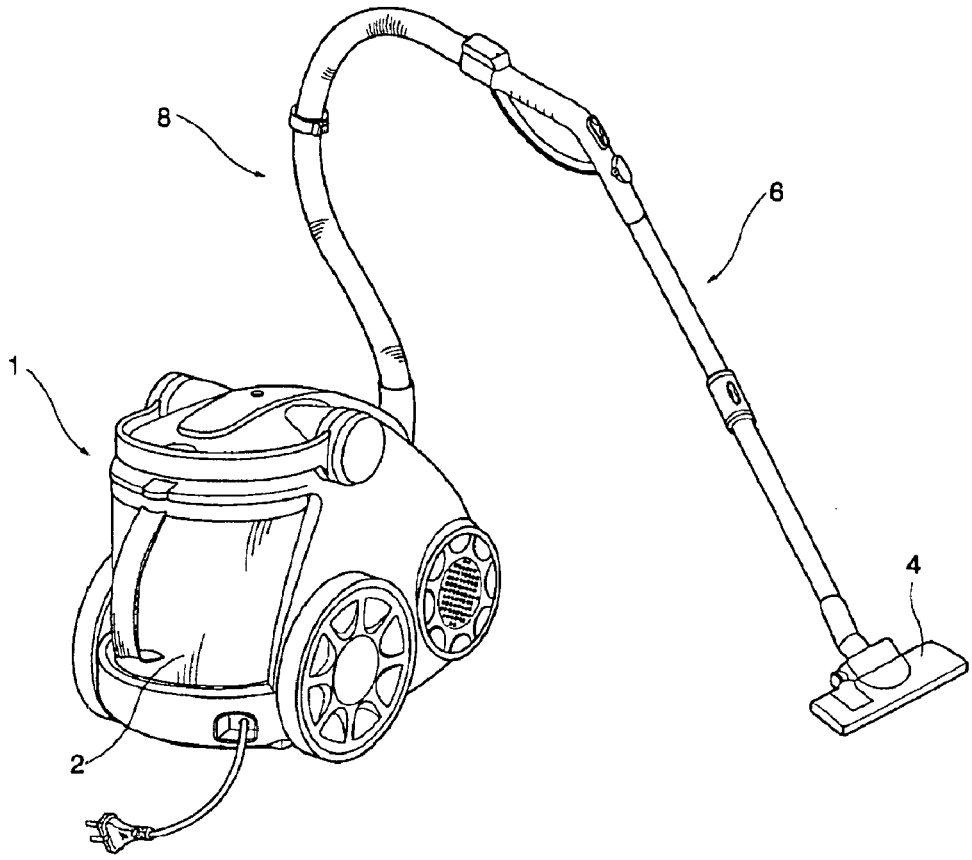
FIG.1 CONVENTIONAL ART
FIG. 1 is an exemplary perspective view of a vacuum cleaner to which the present invention is applicable.
Figure 2:
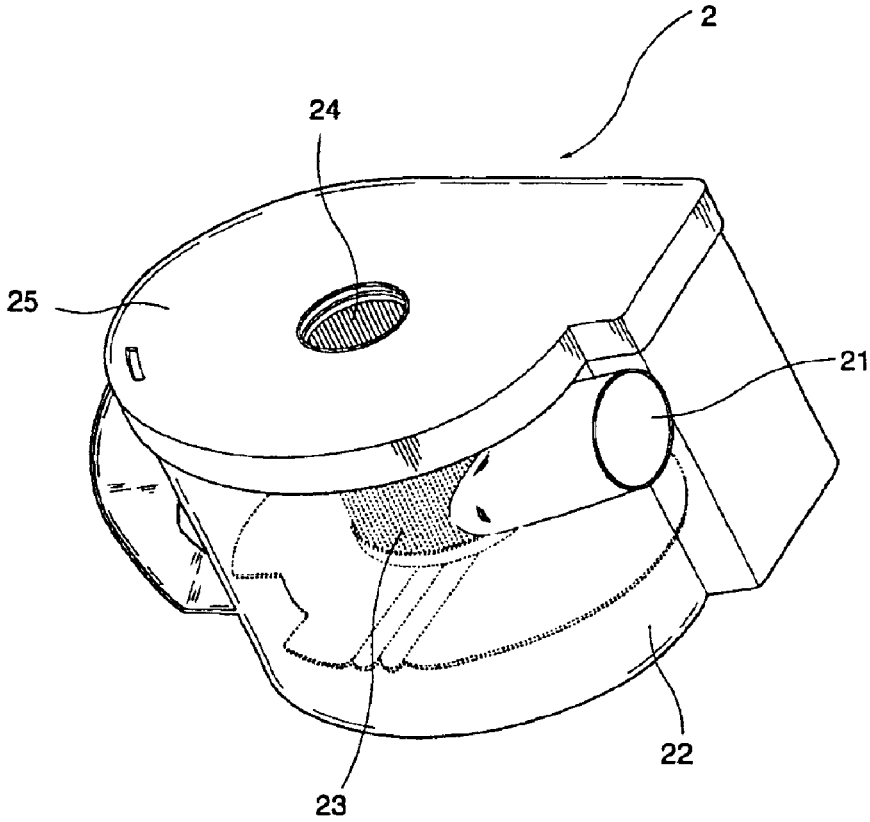
FIG. 2 CONVENTIONAL ART
FIG. 2 is a perspective view of a dust collection unit.
Figure 3:
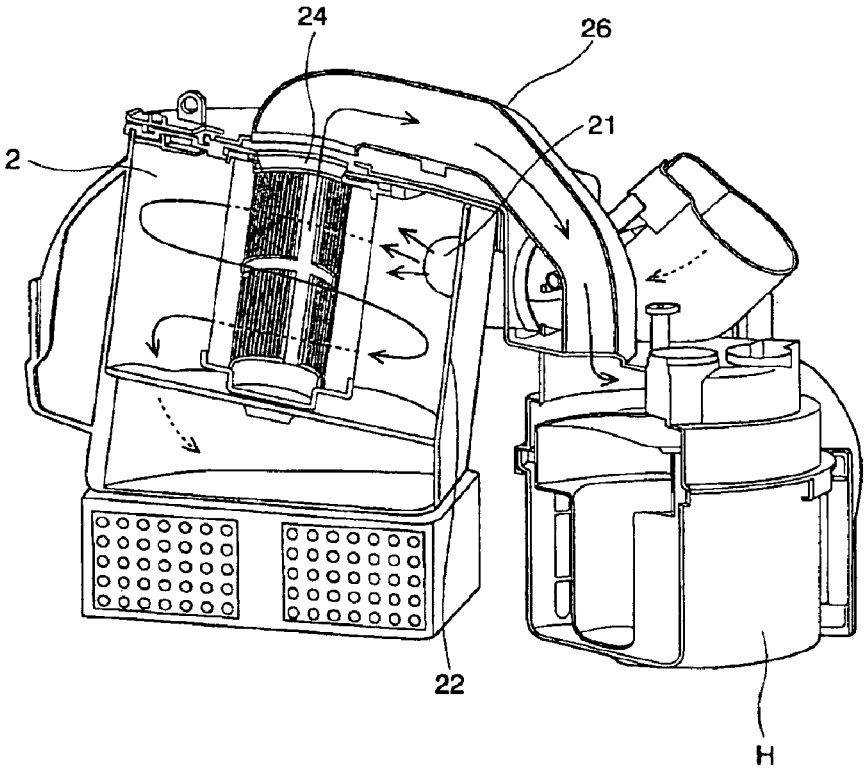
FIG. 3 CONVENTIONAL ART
FIG. 3 is a partially cut-away perspective view of the interior of a main body of a conventional vacuum cleaner.
Figure 4A:
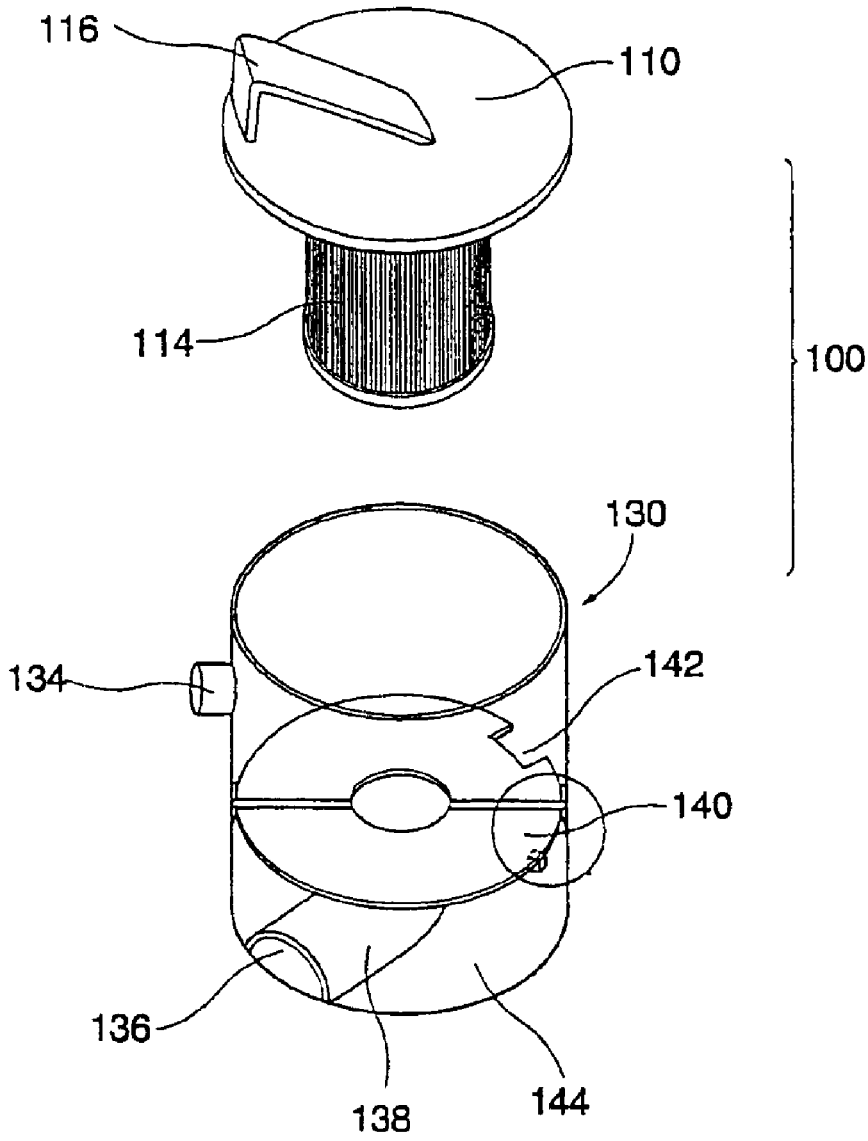
FIG. 4A is an exploded perspective view of a dust collection unit according to the present invention.
Figure 4B:
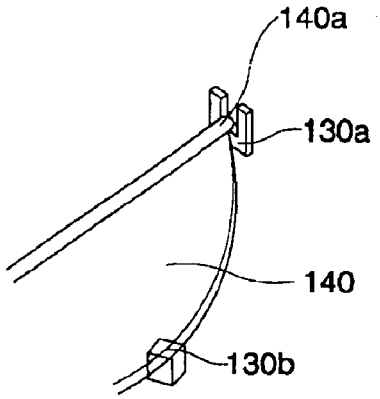
FIG. 4B is an enlarged view of a section of the dust collection unit according to the present invention.
Figure 6:
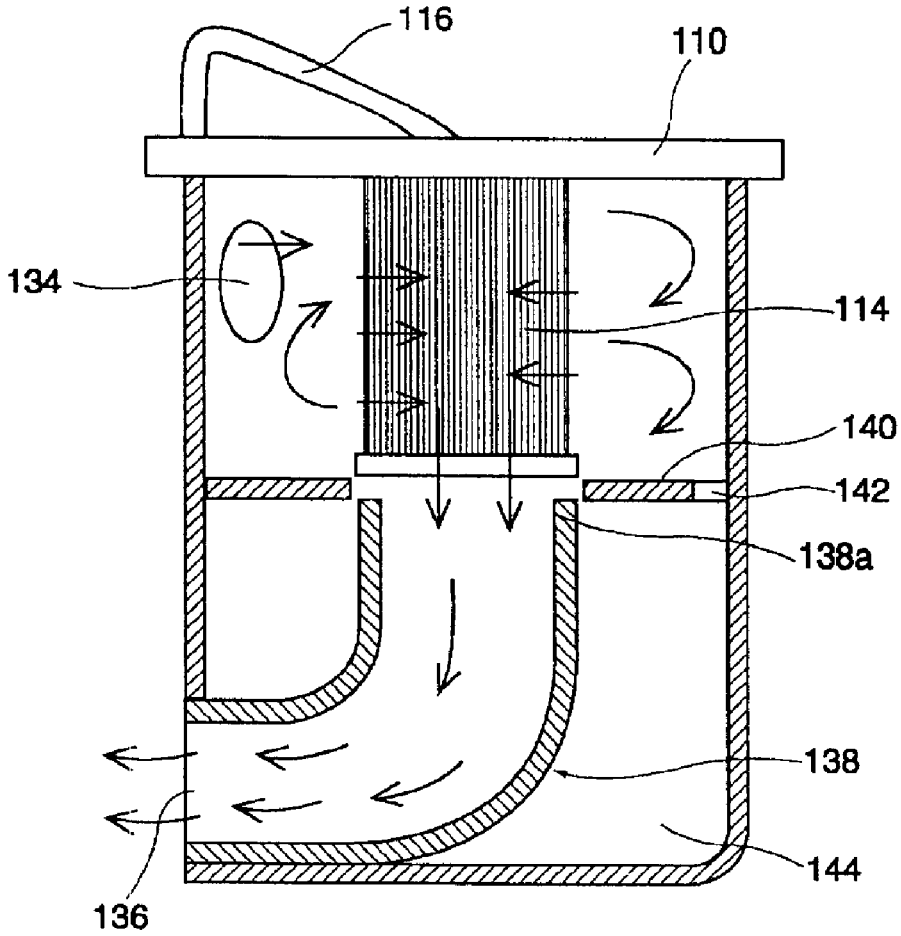
FIG. 6 is a longitudinal sectional view of the dust collection unit according to the present invention.

FIG. 4A is an exploded perspective view of a dust collection unit 100 according to the present invention, FIG. 4B is an enlarged view of a section of the dust collection unit 100 according to the present invention, and FIG. 6 is a longitudinal sectional view of the dust collection unit 100 according to the present invention. As shown in the figures, the dust collection unit 100 includes a casing 130 of which an upper end is open, and a cover 110 for opening and closing the upper end of the casing.

The casing 130 defines a predetermined space therein and is formed in a cylindrical shape. As described later, air containing foreign substances, which is sucked into the casing, is the casing 130, is formed into spiral flow, and relatively heavy (large) foreign substances fall downwardly into the casing due to their own weight. An inlet port 134 is formed on one side of the casing 130. The inlet port 134 is designed to be tangential to an inner surface of the casing 130 so that the air introduced through the inlet port is formed into the spiral flow while flowing along the inner surface of the casing.

The casing 130 is provided with an open upper end, and the cover 110 is installed on the upper end of the casing 130 so as to open and close the casing 130. A filter 114 is installed at a central portion of a bottom surface of the cover 110. It is preferred that the filter 114 is constructed to be detachably installed so that the filter can be easily exchanged and cleaned. The cover 110 is provided with a handle 116 so that a user grips the handle when separating it from the main body of the vacuum cleaner in a case where the filter is filled with the foreign substances such as dusts. Such a handle may also be formed on the casing 130.

The filter 114 serves to filter out fine foreign substances such as dusts contained within air which is introduced into the casing. The filter 114 is formed in the shape of a hollow cylinder. In order to efficiently filter out the aforementioned fine dusts and the like, it is preferred that a contact area of the filter with the air be large as possible. In the shown embodiment, the filter with a plurality of vertical folds formed on the external surface thereof is used to induce sufficient contact of the filter with the air so that the dusts can be efficiently collected.

The filter is constructed such that the fine foreign substances contained within the air can be filtered out while the air within the casing 130 passes from the exterior to the interior of the filter, and the filtered air can be discharged to the exterior of the dust collection unit through an exhaust port 136 to be described later.

Figure 5:
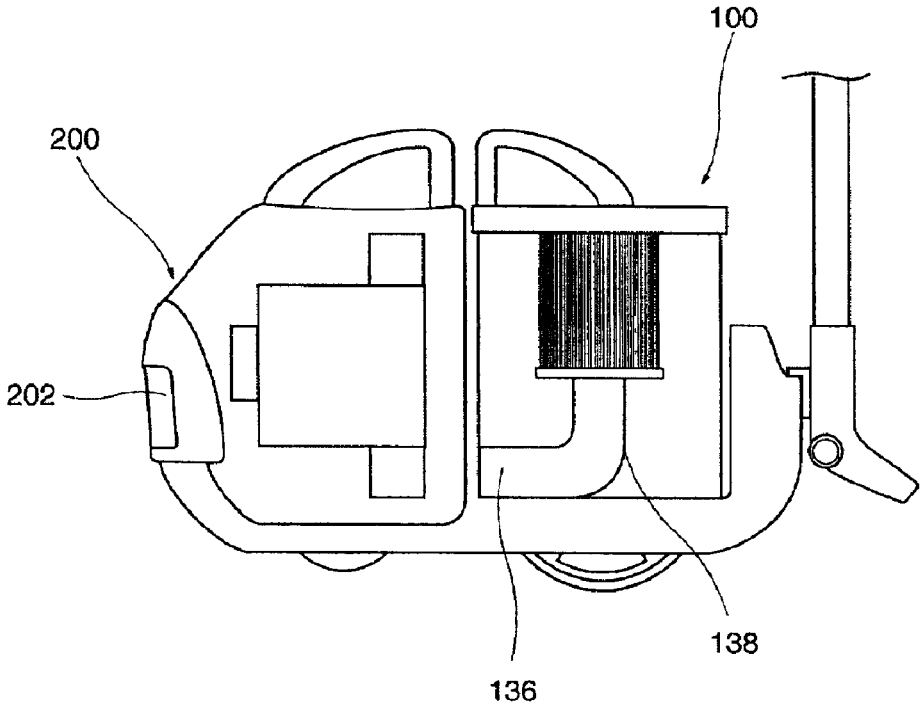
FIG. 5 is a sectional view of a main body of a vacuum cleaner according to the present invention.

The exhaust port 136 is formed on a lower portion of the casing 130. The exhaust port 136 serves to exhaust clean air, from which the fine dusts have been filtered out within the filter 114, to the exterior of the dust collection casing 100. The exhaust port is constructed such that the air from the exhaust port 136 can be introduced into a motor housing H to cool a drive motor within the motor housing, as shown in FIG. 5.

The exhaust port 136 of the present invention is formed on a side surface of the casing 130, as shown in FIGS. 4A and 6. The exhaust port 136 is formed by an exhaust duct 138 which extends downwardly from a vertically middle portion of the casing 130 and then toward the side surface thereof.

As can be seen from FIG. 6, an upper end 138*a* of the exhaust duct 138 is constructed to come into close contact with a bottom surface of the cylindrical filter 114. That is, the air introduced from the exterior to the interior of the cylindrical filter 114 can be discharged through the central portion of the bottom surface of the filter 114, and the discharged air can be introduced directly into the exhaust duct 138.

A separation plate 140 is installed in the middle of the inner surface of the casing 130 according to the present invention. It can be seen that a dust collection hole 142 is formed between an outer circumference of the separation plate 140 and the inner surface of the casing 130.

As shown in FIG. 4A, the separation plate 140 is constructed preferably in the form of a pair of semicircular plates, and most preferably in the form of the plates which can be pivoted upwardly. These plates are used to discharge the foreign substances collected in the dust collection portion 144 to the exterior.

The constitution of the separation plate will be described in detail. As shown in an enlarged section of FIG. 4B, a hinge end 140*a* at an outer circumferential position corresponding to an outmost position of the diameter of the semicircular separation plate 140 is pivotably supported onto a support portion 130*a* formed on the inner surface of the casing 130. For example, the support portion 130*a* may be constructed in the form of a predetermined round groove so that the hinge end 140*a* of the separation plate 140 can be pivotably supported thereon. Furthermore, the support portion 130*a* may be constructed in the form of a hinge hole which is formed into an inner wall of the casing 130 to support the hinge end 140*a* of the separation plate 140.

A support protrusion 130*b* is formed on the inner surface of the casing 130 to catch and support the separation plate 140. Since the separation plate 140 is placed and supported onto the support protrusion 130*b*, the separation plate 140 cannot be substantially pivoted downwardly, and thus can be pivoted only upwardly on the hinge end 140*a*.

In addition to the shown embodiment, various modifications and changes on the constitution that a pair of the semicircular separation plates 140 are kept horizontal in a state where the dust collection unit is properly mounted into the vacuum cleaner (a state where the dust collection unit stands up-right), whereas they are opened to allow the foreign substances within the dust collection portion 144 to be discharged through the open upper end of the casing 130 in a case where the casing is turned upside down, can be made.

Next, the dust-collecting operation and peripheral construction of the dust collection unit for use in the vacuum cleaner according to the present invention constructed as such will be described in detail.

As shown in FIG. 5, the dust collection unit 100 according to the present invention is installed within the main body 200 of the vacuum cleaner. When the vacuum cleaner starts to operate, the drive motor within the motor housing H is driven to generate a suction force by which the air containing the foreign substances is introduced through an inlet 202 of the main body 200. Then, the air containing the foreign substances such as dusts are introduced into the dust collection unit 100 through the inlet port 134 installed on one side of the casing 130. The introduced air is formed into the spiral flow swirling along the inner surface within the casing 130. During the process, heavy foreign substances fall and are collected onto the bottom surface of the casing 130 due to their own weight.

In the shown embodiment, the heavy foreign substances falling downward due to their own weight are collected onto the bottom surface of the casing 130 through the dust collection hole 142 formed on the outer periphery of the separation plate 140.

The air from which the relatively large foreign substances are removed is introduced into the cylindrical filter 114. Further, the foreign substances such as fine dusts are completely filtered out from the air while the air is passing through the filter 114. Thus, the completely filtered air is discharged through the central portion of the bottom surface of the filter 114.

The air discharged through the central portion of the bottom surface of the center of the filter 114 is exhausted through the exhaust duct 138. This means that the air is discharged through the exhaust port 136 formed at the lower portion of the side surface of the casing 130.

The air discharged through the exhaust port 136 can be introduced directly into the motor housing H which is disposed substantially parallel to and adjacent to the dust collection unit 100. Accordingly, the air cools the motor, which is installed within the motor housing H to generate the suction force, and is then discharged to the exterior, i.e. a room.

According to the present invention, the exhaust port 136 of the dust collection unit 100 is installed on the side surface of the casing 130 so that the air can be introduced directly into the motor housing H. Thus, it can be seen that an additional long, curved connection duct is not required since the air can be substantially introduced into the motor housing H through the shortest passage. Furthermore, since the dust collection unit is connected directly to the motor housing H, the number of parts can be decreased and any suction loss generated between the dust collection unit and the motor housing can be minimized.

According to the present invention described above, the exhaust port 136 of the cyclone dust collection unit 100 is installed on the side surface of the casing 130 so that the exhaust port can be connected directly to the motor housing H. With such a constitution, any suction loss of the air can be substantially minimized since the air is supplied through the shortest passage from the dust collection unit 100 to the motor housing. Accordingly, the inner constitution of the main body of the vacuum cleaner can be further simplified. Therefore, there is an advantage in that the number of parts can be reduced and the productivity in the assembly process can be enhanced.

As described above, it can be understood by the skilled in the art that various changes and modifications of the present invention can be made within the scope of the basic technical spirit of the present invention. The present invention should be construed by the accompanying claims.

What is claimed is:

1. A dust collection unit for use in a vacuum cleaner, comprising:

a cylindrical casing in which air introduced through an inlet port is formed into spiral flow and of which an upper end is open;

a cover for opening and closing the upper end of the casing;

a filter which is installed on a bottom surface of the cover and formed in the shape of a cylinder having a predetermined length and by which fine foreign substances can be filtered out when the air is introduced into the filter from the exterior thereof, and through which the air is discharged downwardly; and an exhaust duct which comes into close contact with a bottom surface of the filter and including an exhaust port on a side surface of the casing to discharge the air from the filter to the exterior of the casing.

2. The dust collection unit as claimed in claim 1, wherein the exhaust port is formed at a lower portion of the side surface of the casing.

3. The dust collection unit as claimed in claim 1, wherein a handle is formed on the outer side surface of the casing.

4. The dust collection unit as claimed in claim 1, wherein a handle is formed on one side surface of the cover.

5. The dust collection unit as claimed in claim 1, wherein a horizontal separation plate is installed in the middle of the casing, and a dust collection bole is formed on the outer circumference of the separation plate.

6. The dust collection unit as claimed in claim 5, wherein the separation plate includes a pair of semicircular plates, and the respective semicircular plates are pivoted only upwardly on a hinge end formed on an outer circumferential position thereof corresponding to an outmost position of the diameter thereof.

7. A main body of a vacuum cleaner, comprising:

a motor housing installed within the main body of the vacuum cleaner for accommodating therein a motor for generating suction force; and a dust collection unit installed adjacent to the motor housing, and including an exhaust port through which, after filtering out foreign substances from air introduced by the suction force of the motor, the filtered air is exhausted, wherein the exhaust port of the dust collection unit is formed at a lower portion of a side surface of the dust collection unit so that the air can be introduced directly to the motor housing.

8. The main body as claimed in claim 7, wherein the dust collection unit comprises a cylindrical casing in which air introduced through an inlet port is formed into spiral flow and of which an upper end is open; a cover for opening and closing the upper end of the casing a filter which is installed on a bottom surface of the cover and formed in the shape of a cylinder having a predetermined length and by which fine foreign substances can be filtered out when the air is introduced from the exterior thereof, and through which the air is discharged downwardly; and an exhaust duct which comes into close contact with a bottom surface of the filter and including the exhaust port on a side surface of the casing to discharge the air from the filter to the exterior of the casing.

9. The main body as claimed in claim 8, wherein a handle is formed on the outer side surface of the casing.

10.The main body as claimed in claim 8, wherein a handle is formed on one side of the cover.

11. The main body as claimed in claim 7, wherein a horizontal separation plate is installed in the middle of the casing, and a dust collection hole is formed on the outer circumference of the separation plate.

12. The main body as claimed in claim 11, wherein the separation plate includes a pair of semicircular plates, and the respective semicircular plates are pivoted only upwardly on a hinge end formed on an outer circumferential position thereof corresponding to an outmost position of the diameter thereof.

13. A main body of a vacuum cleaner, comprising a motor housing installed within the main body of the vacuum cleaner for accommodating therein a motor for generating suction force; and a cylindrical dust collection unit installed adjacent to the motor housing, and including an exhaust port through which, after filtering out foreign substances from air introduced by the suction force of the motor, the filtered air is exhausted, wherein the exhaust port of the cylindrical dust collection unit is formed on a cylindrical side surface of the cylindrical dust collection unit so that the air can be introduced directly to the motor housing.

14. The main body as claimed in claim 13, wherein the cylindrical dust collection unit comprises a cylindrical casing in which air introduced through an inlet port is formed into spiral flow and of which an upper end is open.

15. The main body as claimed in claim 14, wherein a handle is formed on the outer side surface of the casing.

16. The main body as claimed in claim 14, wherein a horizontal separation plate is installed in the middle of the casing, and a dust collection hole is formed on the outer circumference of the separation plate.

17. The main body as claimed in claim 16, wherein the separation plate includes a pair of semicircular plates, and the respective semicircular plates are pivoted only upwardly on a hinge end formed on an outer circumferential position thereof corresponding to an outmost position of the diameter thereof.

18. The main body as claimed in claim 14, wherein the cylindrical dust collection unit comprises a cover for opening and closing the upper end of the casing.

19. The main body as claimed in claim 18, wherein a handle is formed on one side of the cover.

20. The main body as claimed in claim 18, wherein the cylindrical dust collection unit comprises a filter which is installed on a bottom surface of the cover and formed in the shape of a cylinder having a predetermined length and by which fine foreign substances can be filtered out when the air is introduced from the exterior thereof, and through which the air is discharged downwardly.

21. The main body as claimed in claim 13, wherein the cylindrical dust collection unit comprises an exhaust duct which comes into close contact with a bottom surface of a filter and includes the exhaust port on a side surface of a casing to discharge the air from the filter to the exterior of the casing.

22. The main body as claimed in claim 21, wherein the exhaust port is formed at a lower portion of the side surface of the casing.

23. The main body as claimed in claim 13, wherein the cylindrical dust collection unit includes a delineated dust collection portion and an exhaust duct formed through the dust collection portion.

* * * * *